United States Patent [19]

Ettel et al.

[11] Patent Number: 4,862,785

[45] Date of Patent: Sep. 5, 1989

[54] APPARATUS FOR DIGITALLY ADJUSTING IN A PROJECTILE A COUNTER FOR STARTING A TIME FUZE

[75] Inventors: Godwin Ettel, Glattbrugg; Markus Suter, Hüttikon, both of Switzerland

[73] Assignee: Werkzeugmaschinenfabrik Oerlikon-Bührle AG, Zurich, Switzerland

[21] Appl. No.: 215,334

[22] Filed: Jul. 5, 1988

[30] Foreign Application Priority Data

Jul. 20, 1987 [CH] Switzerland ..... 2735/87

[51] Int. Cl.[4] ..... F42C 17/00

[52] U.S. Cl. ..... 89/6.5; 89/1.1

[58] Field of Search ..... 89/1.1, 6.5

[56] References Cited

U.S. PATENT DOCUMENTS

| | | | |
|---|---|---|---|
| 3,958,510 | 5/1976 | Stützle | 89/615 |
| 4,022,102 | 5/1977 | Ettel | 89/6.5 |
| 4,080,869 | 3/1978 | Karayannis et al. | 89/6.5 |
| 4,142,442 | 3/1979 | Tuten | 89/6.5 |
| 4,283,989 | 8/1981 | Toulios et al. | 89/6.5 |
| 4,320,704 | 3/1982 | Gawlick et al. | 89/6.5 |
| 4,649,796 | 3/1987 | Schmidt | 89/6.5 |
| 4,664,013 | 5/1987 | Wegner et al. | 89/6.5 |

FOREIGN PATENT DOCUMENTS 2605374 9/1976 Fed. Rep. of Germany .

*Primary Examiner*—David H. Brown

*Attorney, Agent, or Firm*—Werner W. Kleeman

[57] ABSTRACT

A transmitter coil is located at the muzzle of a firing weapon downstream of a muzzle velocity measuring device as viewed in the flight direction of a projectile after firing. The transmitter coil transmits a digital adjustment signal for inductively adjusting in the projectile during its passage through the transmitter coil, a counter for starting a delayed action fuze in the projectile. The individual digital adjustment signals are constituted by double pulses and a predetermined number such as at least 12 double pulses are transmitted by the transmitter coil to the receiver coil in the projectile. Electronic switches are utilized for controlling the operation of the transmitter coil. A filtering device is connected in circuit with the receiver coil and the counter in the projectile for eliminating interfering pulses which originate from the muzzle velocity measuring device.

8 Claims, 3 Drawing Sheets

FIG. 2
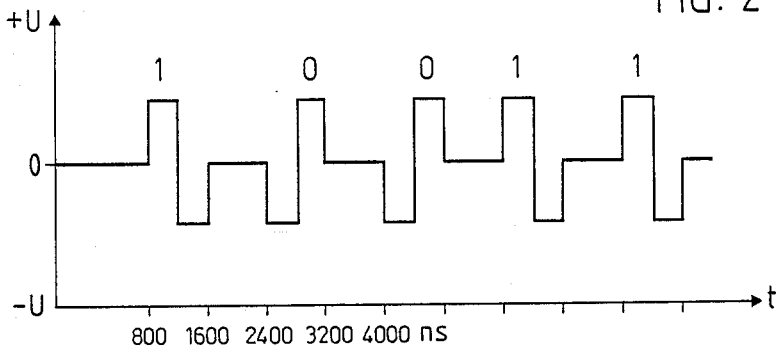
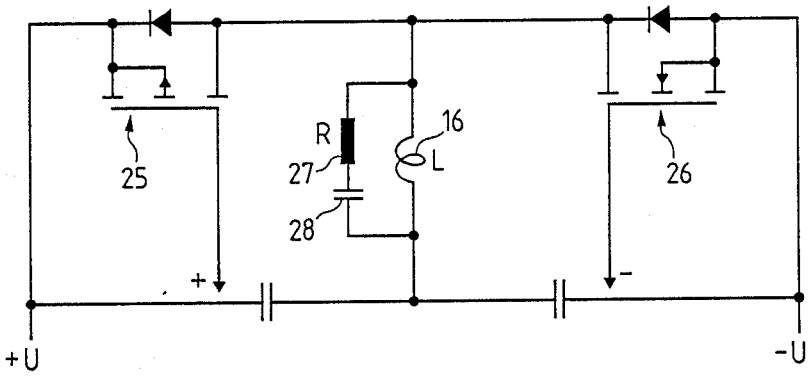
FIG. 3
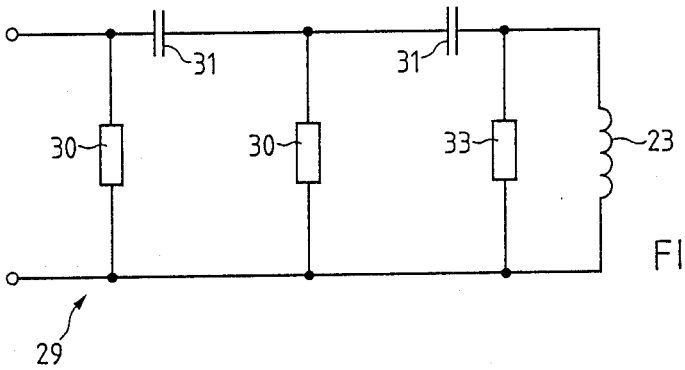
FIG. 4

APPARATUS FOR DIGITALLY ADJUSTING IN A PROJECTILE A COUNTER FOR STARTING A TIME FUZE

BACKGROUND OF THE INVENTION

The present invention relates to a new and improved construction of an apparatus for adjusting in a projectile, after firing the projectile from a firing weapon through the muzzle of said firing weapon, a counter controlling a time or delayed action fuze in the projectile.

In its more particular aspects, the present invention specifically relates to a new and improved apparatus for adjusting in a projectile, after firing the projectile from a firing weapon through the muzzle of such firing weapon, a counter which controls a time or delayed action fuze in the projectile. The counter is inductively set by means of a transmitter or induction coil which is mounted at the firing weapon downstream from a muzzle velocity measuring device or means, and a receiver coil which is located in the time or delayed action fuze of the projectile. The counter for starting the time or delayed action fuze may be typically set as a function of the muzzle velocity which is measured by the muzzle velocity measuring device or means.

In an apparatus of this type as known, for example, from U.S. Pat. No. 4,022,102, granted May 10, 1977, the transmitter or induction coil is capable of transmitting approximately 8 to 10 pulses during the passage of the projectile through such transmitter coil. In order to distinctly transmit, from the transmitter or induction coil to the receiver coil, two different digital signals, namely the digital signals "0" and "1", by means of this prior art device, the transmitter coil is magnetized in one direction for transmitting the digital signal "0" and in the opposite direction for transmitting the digital signal "1". For this purpose, a positive voltage is applied to the transmitter or induction coil for one of the two digital signals and, thereafter, a negative voltage is applied to the transmitter or induction coil for transmitting the other one of the two digital signals. Consequently, the current is selectively flowing or passed through the transmitter or induction coil in one or in the other, i.e. the opposite direction. The transmitter or induction coil is thereby fully magnetized for the digital signal "0" as well as for the digital signal "1". The transmitter or induction coil is not magnetized during the intervals between the two digital signals "0" and "1".

When utilizing this type of signal transmission, there is required between the individual digital signals a dead time or dead time interval which amounts to approximately the tenfold of the pulse duration of each one of the digital signals. When the transmitter or induction coil has a length of 12 cm and the muzzle velocity of the fired projectile is assumed to be 1200 m/sec, only a limited time period is available for the transmitter or induction coil for transmitting at least 8 to 10 pulses during passage of the projectile through the transmitter or induction coil and, therefore, a transmission frequency of 100 kHz is required.

In a further arrangement of this type as known, for example, from German Patent Publication No. 2,316,976, published Oct. 17, 1974, a control coil is mounted at the muzzle of the weapon barrel. During the throughpassing flight of the projectile, the time period for starting or activating the fuze is determined by means of a receiver in the projectile fuze.

In this known arrangement, a current passes through the control coil and the magnitude of this current is a measure of the value intended to be adjusted or set. The receiver circuit contains a receiver coil and means for evaluating the magnitude of the voltage which is induced in the receiver coil during the throughpassing flight of the projectile through the control coil.

Such arrangement is not sufficiently precise for present requirements. The magnitude of the voltage which is induced in the receiver coil during the throughpassing flight of the projectile through the control coil, firstly, is dependent upon whether the projectile exactly centrally flies or passes through the control coil and, secondly, whether the projectile flies or passes through the control coil exactly at the desired muzzle velocity.

SUMMARY OF THE INVENTION

Therefore, with the foregoing in mind, it is a primary object of the present invention to provide a new and improved construction of an apparatus for adjusting in a projectile, after firing the projectile from a firing weapon through the muzzle of the firing weapon, a counter controlling a time or delayed action fuze in the projectile, and which apparatus is not afflicted with the aforementioned drawbacks and shortcomings of the prior art constructions.

Another and more specific object of the present invention is directed to providing an apparatus for adjusting in a projectile, after firing the projectile from a firing weapon through the muzzle of the firing weapon, a counter controlling a time or delayed action fuze in the projectile, and which apparatus is capable of transmitting from the transmitter or induction coil to the receiver coil a greater number of pulses within the period of time which is available during the throughpassage of the projectile through the transmitter or induction coil.

Yet another significant object of the present invention is directed to a new and improved construction of an apparatus for adjusting in a projectile, after firing the projectile through the muzzle of the weapon, a counter controlling a time or delayed action fuze in the projectile, and which apparatus is improved with respect to the redundancy of the pulses transmitted by the transmitter or induction coil so that there is obtained more reliable data transfer to the receiver coil in the projectile.

Still a further important object of the present invention resides in providing a new and improved construction of an apparatus for adjusting in a projectile, after firing the projectile from a firing weapon through the muzzle of the firing weapon, a counter controlling a time or delayed action fuze in the projectile, and which apparatus is capable of eliminating or at least minimizing the effects of undesired interfering pulses which originate, for example, from a muzzle velocity measuring device or means which are mounted at the muzzle of the firing weapon.

Now in order to implement these and still further objects of the invention, which will become more readily apparent as the description proceeds, the apparatus of the present development is manifested, among other things, by selected ones or desired combinations of the following features that:

(i) The pulses transmitted from the transmitter or induction coil to the receiver coil, constitute double pulses.

(ii) An ohmic resistor is connected in parallel with the transmitter or induction coil for optimizing the time constant L/R.

(iii) An ohmic resistor is connected in parallel with the receiver coil in order to optimize the time constant L/R.

(iv) Filtering means are connected to the receiver coil in order to eliminate interfering pulses which originate or are radiated, for example, by the muzzle velocity measuring device or means.

One of the advantages of the inventive construction of the apparatus, in comparison to the aforementioned prior art constructions, is the following:

The generation of double pulses enables substantially shortening the dead time or dead time interval between the individual digital signals. Instead of a dead time or dead time interval which amounts to the tenfold of the pulse duration, it is sufficient, due to the double pulse nature of the transmitted pulses, to use a dead time or dead time interval which has substantially the same time duration as the double pulse.

Additionally, such short dead time or dead time interval is further rendered possible by shortening the pulse decay time. Using an ohmic resistor of, for example, 3 Ohms, the time constant (L/R) can be adjusted or set to about 150 ns. This results in a fast or rapid decay of the induced voltage pulse in the receiver coil of the projectile and thus in short dead times or dead time intervals between the individual pulses. Due to the presence of the ohmic resistor which is connected in parallel with the transmitter or induction coil, an amplifier can be dispensed with in the generating circuit for generating the pulses. In other words, through the use of the time constant producing components there can be provided optimum conditions for realization of sharp pulses with short interpause intervals and thus optimum data transmission times and conditions.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 2 is a diagram showing a sequence of double pulses of the type transmitted by the inventive apparatus;

FIG. 3 is a schematic circuit diagram showing the transmitter or induction coil and its immediately related circuit components in the exemplary embodiment of the inventive apparatus;

FIG. 4 is a schematic circuit diagram showing the receiver coil and its immediately related circuit components in the exemplary embodiment of the inventive apparatus.

DETAILED DESCRIPTION OF THE PREFERRED EMBODIMENTS

Figure 1:
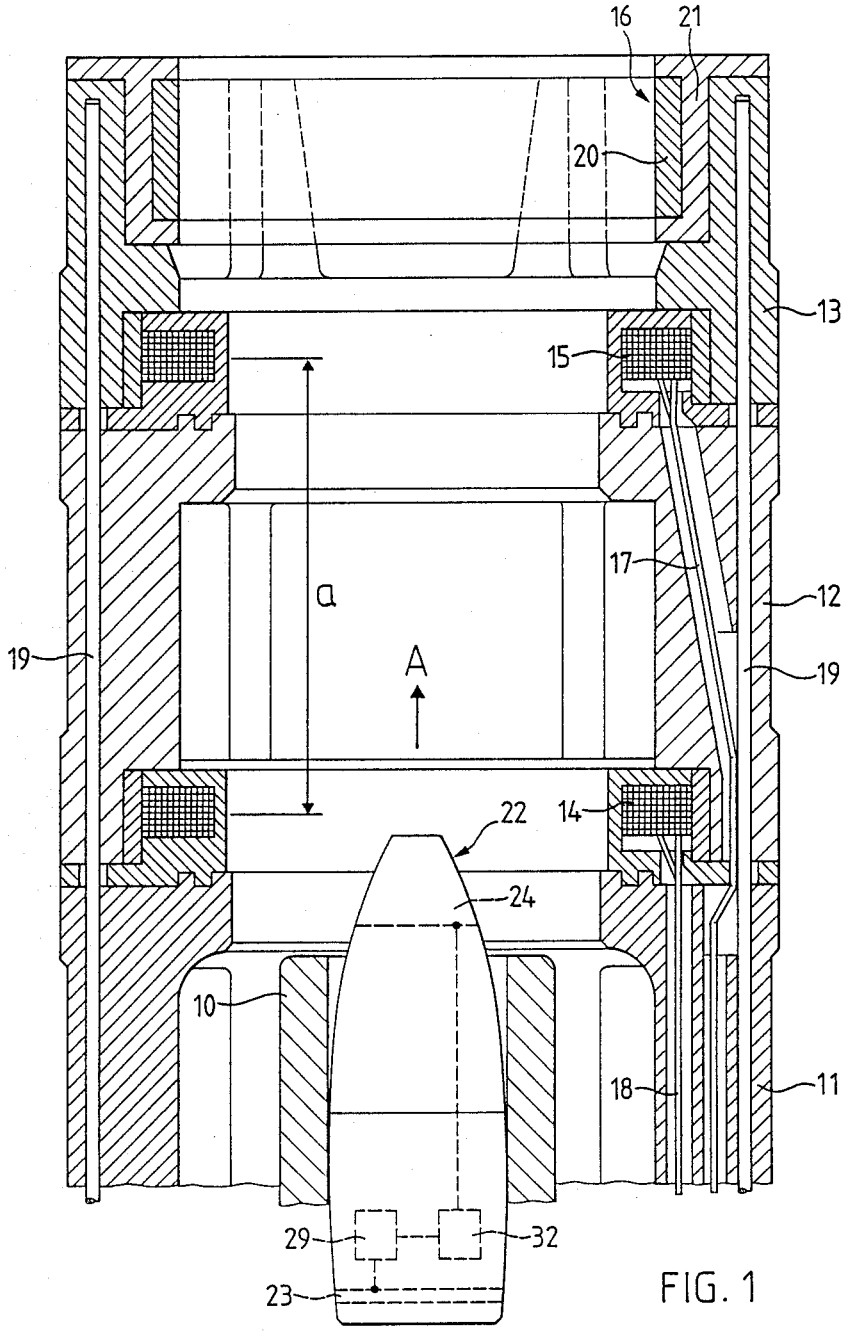
FIG. 1 shows a longitudinal section through a muzzle of a weapon barrel containing muzzle velocity measuring means and a transmitter coil in an exemplary embodiment of the inventive apparatus for transmitting digital adjustment signals to a projectile which issues from the muzzle of the weapon barrel.

Describing now the drawings, it is to be understood that to simplify the showing thereof, only enough of the construction of the inventive apparatus has been illustrated therein as is needed to enable one skilled in the art to readily understand the underlying principles and concepts of the present development. Turning attention now specifically to FIG. 1 of the drawings, there has been illustrated therein by way of example and not limitation, a muzzle 10 of a weapon barrel and such muzzle 10 is surrounded by a three-membered cage 11, 12, 13 which protrudes beyond the muzzle 10. The three-membered cage 11, 12, 13 is constructed in conventional manner and the cage members 11, 12 and 13 are interconnected and connected to the muzzle 10 in conventional manner which, therefore, is not described here.

In a central member 12 of the three-membered cage 11, 12, 13, there is located a first measuring coil 14 of a muzzle velocity measuring device or means 14, 15. A front member 13 of the three-membered cage 11, 12, 13, contains a second measuring coil 15 of the muzzle velocity measuring device or means 14, 15 and a transmitter or induction coil 16 of the inventive apparatus. Respective lines or conductors 17 and 18 are provided for electrically powering the two measuring coils 14 and 15. The transmitter or induction coil 16 of the inventive apparatus consists of a single winding or turn 20 and a coil support or carrier 21.

For screening against interferences due to magnetic fields, the entire measuring installation at the muzzle 10 contains a predetermined number of soft iron rods 19 which are inserted into the three-membered cage 11, 12, 13 and of which only two are visible in the illustration of FIG. 1.

After firing, a projectile 22 flies or passes in the direction of the arrow A, through the measuring coils 14 and 15 of the muzzle velocity measuring device or means 14, 15 and, thereafter, through the transmitter or induction coil 16 for data transfer. As already explained, such transmitter coil 16 comprises a single winding 20 and is relatively narrow, i.e. has a comparatively small axial length as compared to the transmitter coil used in the apparatus according to the initially mentioned U.S. Pat. No. 4,022,102 and which transmitter coil has about twice the axial length as the transmitter coil 16 in the inventive construction.

For determining the initial or muzzle velocity of the projectile 22, the time t is measured which is required by the projectile 22 to arrive at the measuring coil 15 from the measuring coil 14 of the muzzle velocity measuring device or means 14, 15. Since the distance or spacing a between the two measuring coils 14 and 15 is known, the muzzle velocity is computed according to the equation $V_o=a/t$.

On account of such muzzle velocity of the projectile 22, there can be computed the time period required by the projectile 22 for reaching the target. Thus, a time or delayed action fuze 24 which is located within the projectile 22, can be adjusted or set or timed in a manner such that the projectile 22 is detonated in the region of the target. Data which are representative of this time period required by the projectile 22 for reaching the target after exit from the muzzle 10 of the firing weapon barrel, are transmitted or transferred in digital manner from the transmitter or induction coil 16 to a receiver coil 23 which is located within the projectile 22. Such data transmission or transfer is conventionally effected in an inductive manner.

For adjusting or setting the time or delayed action fuze 24 in the projectile 22 at the desired precision, at least 12 pulses should be transmitted from the transmitter or induction coil 16 to the receiver coil 23. Since, as already mentioned hereinbefore, the projectile 22 flies or passes through the transmitter or induction coil 16 of the inventive apparatus at a velocity of, for instance, approximately 1200 m/sec, it is required that the 12 pulses are transmitted at relatively high frequency and at the correct moment of time. Such correct moment of time for transmitting the pulses is determined using the aforementioned front measuring coil 15 of the muzzle velocity measuring device or means 14, 15. As soon as the projectile 22 has passed through this front measuring coil 15, the data or information can be transmitted from the transmitter or induction coil 16 to the receiver coil 23 of the inventive apparatus.

In order that the pulses may be transmitted from the transmitter or induction coil 16 to the receiver coil 23 at the required frequency, it is necessary to reduce the inertia of the transmitter or induction coil 16 as much as possible and to replace other comparatively sluggish operating or inertia-afflicted elements like, for example, amplifiers by other components which have less inertia.

In the following, the measures taken for increasing the frequency of inductive pulse transmission from the transmitter or induction coil 16 to the receiver coil 23 of the projectile 22, will now be explained hereinbelow with reference to FIGS. 2 and 3.

FIG. 2 shows the characteristic shape of the digital adjustment signals or pulses which are generated in the inventive apparatus and transmitted by the transmitter or induction coil 16. As illustrated, the digital signal "1" is composed of two pulses or constitutes a double pulse. A first portion of this double pulse is produced by a positive-going voltage "+U" and a second portion of the double pulse is produced by a negative-going voltage "−U". The digital signal "0" analogously contains two pulses or constitutes a double pulse. A first portion of the double pulse is produced by a negative-going voltage "−U" and a second portion of the double pulse is produced by a positive-going voltage "+U". In FIG. 2, the voltage changes are plotted as a function of time and it is apparent from such FIG. 2 that the positive-going pulse "+U" as well as the negative-going pulse "−U" has a time duration of, for example, 400 ns. Consequently, the time period required for each double pulse amounts to, for example, 800 ns and since, as already explained hereinbefore, the dead time or dead time interval between the individual double pulses can be made substantially equal to the pulse duration, 800 ns are sufficient for the dead time or dead time interval or interpause between the individual double pulses. By virtue of such double pulses it is possible to utilize a dead time or dead time interval which is smaller by a factor of 10 as compared with the prior art apparatus.

FIG. 3 shows in a schematic circuit diagram, the transmitter or induction coil 16 and the immediately related components of the inventive apparatus. As shown, the transmitter or induction coil 16 is connected to two electronic switches or switch means 25 and 26 for selectively generating positive-going pulses "+U" or negative-going pulses "−U". In order to optimize the time constant (L/R), i.e. the decay time of the double pulse, an ohmic resistor 27 is connected in parallel with the transmitter or induction coil 16. This ohmic resistor 27 is shown series connected with a capacitor 28 for controlling current flow through the ohmic resistor 27 at the desired moment of time. The provision of the ohmic resistor 27 and capacitor 28 has the beneficial effect of damping oscillations in the transmitter or induction coil 16. The terminal or output amplifier which hitherto has been conventional in this type of apparatus for controlling the transmitter or induction coil, is beneficially replaced by a switching stage, i.e. the aforementioned electronic switches or switch means 25 and 26 in the inventive construction and the fast switching times of such electronic switches can be desirably fully exploited through the aforedescribed time constant producing components.

FIG. 4 shows a schematic circuit diagram of the receiver coil 23 and its immediately related components in the projectile 22. A resistor 33 is connected in parallel with the receiver coil 23 and such resistor 33 forms, conjointly with the receiver coil 23, a time constant L/R in conventional manner. Filtering means 29 are connected with the combination of the receiver coil 23 and the resistor 33 and such filtering means 29 are constructed in conventional manner from ohmic resistors 30 and capacitors 31 in the manner of a high-pass filter. The filtering means 29 prevent pulses which originate from the muzzle velocity measuring device or means 14, 15, from being transmitted as interfering pulses from the receiver coil 23 through the counter 32, see FIG. 1, to the time or delayed action fuze 24.

The components of the schematic circuit diagrams shown in FIGS. 3 and 4 have the following electrical characteristics:

(a) Transmitter or induction coil 16: 0.5 μH (Microhenry);
(b) Ohmic resistor 27: 4Ω (Ohms);
(c) Capacitor 28: 50 nF (Nanofarad);
(d) Electronic switches 25 and 26: commercially available under the designations IRF 540 and IRF 9540;
(e) Capacitors 31: 120 pF (Picofarad);
(f) Resistors 30: 22 kΩ; and
(g) Resistor 33: 6.8 kΩ.

Figure 5:
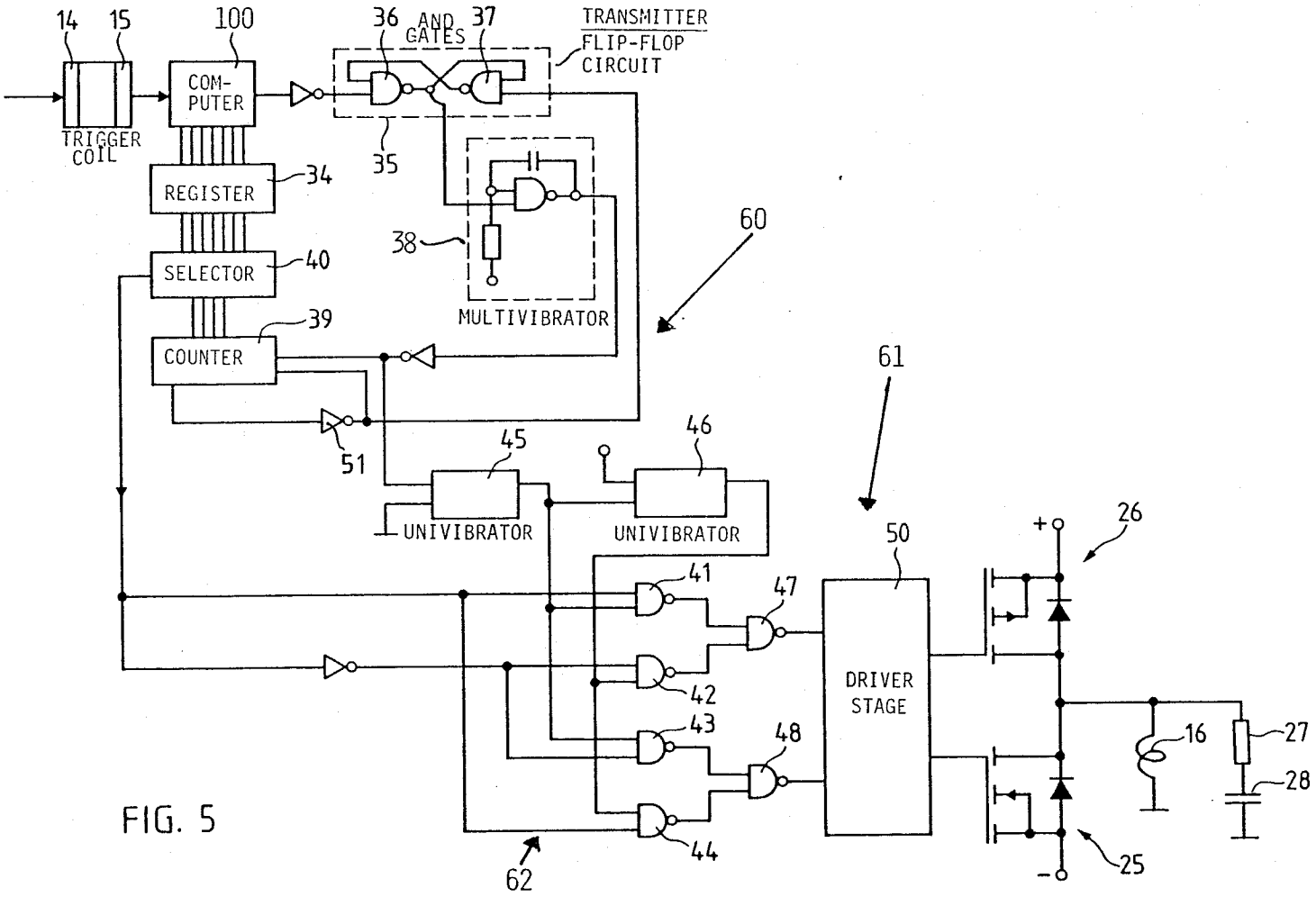
FIG. 5 is a block circuit diagram showing the transmission control circuit and the double pulse generating circuit of the exemplary embodiment of the inventive apparatus.

FIG. 5 shows, in a schematic block circuit diagram, the construction of the transmission control circuit 60 for operating the transmitter or induction coil 16. The two measuring coils 14 and 15 of the muzzle velocity measuring device or means 14, 15 are connected to a process computer 100 for computing the aforementioned muzzle velocity from the distance of the spacing a between the measuring coils 14 and 15 and the time required by the projectile 22 for passing from the first measuring coil 14 to the second measuring coil 15. Other triggering means, for example, a trigger coil may be used for starting the operation of the process computer 100, as described, for example, in the initially mentioned U.S. Pat. No. 4,022,102. Furthermore, the process computer 100 is connected to a register 34 and a flip-flop circuit 35 containing two AND gates 36 and 37. From the measuring coils 14 and 15, the process computer 100 is supplied with data indicating that the projectile 22 is present in the region of the two measuring coils 14 and 15. Consequently, the process computer 100 is enabled to compute at which time the projectile 22 will pass through the transmitter or induction coil 16.

As a result, the process computer 100 supplies, to the flip-flop circuit 35, a signal for initiating the transfer of data which are stored by the process computer 100 in the register 34 and which relate to the setting of the counter 32 connected to the time or delayed action fuze 24 in the projectile 22. A multivibrator 38 is connected to the flip-flop circuit 35 and delivers pulses at regular time intervals to a counter 39 in conventional manner. The multivibrator 38 is started or set into operation by means of the flip-flop circuit 35.

A selector 40 is arranged or connected in circuit between the register 34 and the counter 39. This selector 40 selects the numbers or data contained in the register 34 in correspondence to the numbers which are counted or formed in the counter 39 by means of the multivibrator 38 and supplies these numbers or data or information to logic circuit means 62 of a pulse generating circuit 61 interconnecting the transmission control circuit 60 and the transmission or induction coil 16. The logic circuit means 62 are constituted by, for instance, four NAND gates 41 through 44, and the numbers or data or information are specifically supplied to one input at each one of the NAND gates 41 through 44. There are further provided two univibrators 45 and 46 which are respectively connected to the respective other inputs of the NAND gates 41, 42 and 43, 44. These univibrators 45 and 46 conjointly generate, for each one of the numbers, data or information i.e. each double pulse to be transmitted or transferred, a pulse having a predetermined time duration, for example, of 800 nanoseconds.

The logic circuit means 62 further comprises two NAND gates 41 and 48. The outputs of the NAND gates 47 and 42 are connected to the inputs of the NAND gate 47 and the outputs of the NAND gates 43 and 44 are connected to the inputs of the NAND gate 48. The outputs of the two NAND gates 47 and 48 are connected to a driver stage 50.

This driver stage 50 controls the electronic switches or switch means 25 and 26 which were already mentioned hereinbefore with reference to FIG. 3. Specifically, an output from the NAND gate 47 activates, through the driver stage 50, the electronic switch 26 so that a positive-going pulse is applied to the transmitter or induction coil 16. Conversely, a negative-going pulse is applied to the transmitter or induction coil 16 when an output signal appears at the output of the NAND gate 48 and activates the electronic switch 25 through the driver stage 50. As a consequence, the double pulses of the type as illustrated in FIG. 2, are transmitted by the transmitter or induction coil 16. These double pulses or signals, then, are specifically transmitted by the transmitter or induction coil 16 to the receiver coil 23 in the projectile 22 as shown in FIG. 1 and illustrated in FIG. 4.

The aforementioned counter 39 which receives the pulses generated by the multivibrator 38, is connected to the flip-flop circuit 35 through a gate 51 whereby the entire transmission control circuit 60 can be reset into the original condition or state following each transmitting operation.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for adjusting in a projectile, after firing the projectile from a firing weapon through a muzzle of the firing weapon, a counter controlling a delayed action fuze in the projectile, said apparatus comprising:

a transmitter coil mounted at the firing weapon in the region of said muzzle and for transmitting a digital adjustment signal for adjusting the counter controlling the delayed action fuze in said projectile;

a transmission control circuit operatively connected to said transmitter coil;

means for triggering said transmission control circuit;

said transmission control circuit generating, after triggering by said means, said digital adjustment signal transmitted by said transmitter coil for adjusting said counter controlling said delayed action fuze in said projectile;

a receiver coil located in said projectile and operatively connected to said counter controlling the delayed action fuze in said projectile;

said receiver coil receiving said digital adjustment signal transmitted by said transmitter coil during passage of said projectile through said transmitter coil;

a pulse generating circuit connected in circuit between said transmission control circuit and said transmitter coil; and said pulse generating circuit containing logic circuit means for generating a predetermined number of double pulses each comprising an immediate sequence of two pulses having opposite polarities for controlling said transmitter coil to generate, as said digital adjustment signal, an adjustment signal comprising a predetermined number of double pulses each comprising an immediate sequence of two pulses having opposite polarities.

2. The apparatus as defined in claim 1, wherein:

said means for triggering said transmission control circuit contain muzzle velocity measuring means mounted at the muzzle of the firing weapon for measuring the muzzle velocity of the projectile;

said muzzle velocity measuring means being connected to said transmission control circuit; and said muzzle velocity measuring means being mounted at said muzzle upstream of said transmitter coil as viewed in the flight direction of the projectile after firing.

3. The apparatus as defined in claim 1, wherein:

said pulse generating circuit further contains:

two electronic switches connected to respective poles of opposite polarities and in circuit with said transmitter coil; and a driver stage interconnecting said logic circuit means and said two electronic switches for generating at said transmitter coil, as said digital adjustment signal, said predetermined number of double pulses each comprising an immediate sequence of two pulses having opposite polarities.

4. The apparatus as defined in claim 1, further including:

an ohmic resistor connected in parallel with said transmitter coil for optimizing the time constant for data transfer and thereby the transmission of said predetermined number of double pulses.

5. The apparatus as defined in claim 1, further including:

an ohmic resistor connected in parallel with said receiver coil in said projectile for optimizing the time constant for data transfer and setting of said counter.

6. An apparatus for adjusting in a projectile, after firing the projectile from a firing weapon through a muzzle of the firing weapon, a counter controlling a delayed action fuze in the projectile, said apparatus comprising:

a transmitter coil mounted at the firing weapon in the region of said muzzle and for transmitting a digital adjustment signal for adjusting the counter controlling the delayed action fuze in said projectile;

a transmission control circuit operatively connected to said transmitter coil;

means for triggering said transmission control circuit;

said transmission control circuit generating, after triggering by said means, said digital adjustment signal transmitted by said transmitter coil for adjusting said counter controlling said delayed action fuze in said projectile;

a receiver coil located in said projectile and operatively connected to said counter controlling the delayed action fuze in said projectile;

said receiver coil receiving said digital adjustment signal transmitted by said transmitter coil during passage of said projectile through said transmitter coil;

a pulse generating circuit connected in circuit between said transmission control circuit and said transmitter coil;

said pulse generating circuit generating, as said digital adjustment signal, an adjustment signal comprising a predetermined number of double pulses;

a series connection of an ohmic resistor and a capacitor; and said series connection of said ohmic resistor and said capacitor being connected in parallel with said transmitter coil for shaping said predetermined number of double pulses by damping oscillations in said transmitter coil.

7. An apparatus for adjusting in a projectile, after firing the projectile from a firing weapon through a muzzle of the firing weapon, a counter controlling a delayed action fuze in the projectile, said apparatus comprising:

a transmitter coil mounted at the firing weapon in the region of said muzzle and for transmitting a digital adjustment signal for adjusting the counter controlling the delayed action fuze in said projectile;

a transmission control circuit operatively connected to said transmitter coil;

means for triggering said transmission control circuit;

said transmission control circuit generating, after triggering by said means, said digital adjustment signal transmitted by said transmitter coil for adjusting said counter controlling said delayed action fuze in said projectile;

a receiver coil located in said projectile and operatively connected to said counter controlling the delayed action fuze in said projectile;

said receiver coil receiving said digital adjustment signal transmitted by said transmitter coil during passage of said projectile through said transmitter coil;

a pulse generating circuit connected in circuit between said transmission control circuit and said transmitter coil;

said pulse generating circuit generating, as said digital adjustment signal, an adjustment signal comprising a predetermined number of double pulses.

said means for triggering said transmission control circuit containing muzzle velocity measuring means mounted at the muzzle of the firing weapon for measuring the muzzle velocity of the projectile;

said muzzle velocity measuring means being connected to said transmission control circuit;

said muzzle velocity measuring means being mounted at said muzzle upstream of said transmitter coil as viewed in the flight direction of the projectile after firing; and filtering means connected with said receiver coil in said projectile for eliminating interfering pulses originating from said muzzle velocity measuring means.

8. An apparatus for adjusting in a projectile, after firing the projectile from a firing weapon through a muzzle of the firing weapon, a counter controlling a delayed action fuze in the projectile, said apparatus comprising:

a transmitter coil mounted at the firing weapon in the region of said muzzle and for transmitting a digital adjustment signal for adjusting the counter controlling the delayed action fuze in said projectile;

a transmission control circuit operatively connected to said transmitter coil;

means for triggering said transmission control circuit;

said transmission control circuit generating, after triggering by said means, said digital adjustment signal transmitted by said transmitter coil for adjusting said counter controlling said delayed action fuze in said projectile;

a receiver coil located in said projectile and operatively connected to said counter controlling the delayed action fuze in said projectile;

said receiver coil receiving said digital adjustment signal transmitted by said transmitter coil during passage of said projectile through said transmitter coil;

a pulse generating circuit connected in circuit between said transmission control circuit and said transmitter coil;

said pulse generating circuit containing:

logic circuit means connected to said transmission control circuit and receiving therefrom signals representative of the desired time delay of said delayed action fuze in said projectile;

said logic circuit means generating double pulses each of which comprises an immediate sequence of two pulses of opposite polarities, in a predetermined number representative of said desired time delay, for controlling said transmitter coil;

two electronic switches connected to respective poles of opposite polarities and in circuit with said transmitter coil; and a driver stage interconnecting said logic circuit means and said two electronic switches for generating at said transmitter coil, as said digital adjustment signal, a predetermined number of double pulses each of which comprises an immediate sequence of two pulses of opposite polarities.

* * * * *

UNITED STATES PATENT AND TRADEMARK OFFICE

CERTIFICATE OF CORRECTION

PATENT NO. : 4,862,785

DATED : September 5, 1989

INVENTOR(S) : GODWIN ETTEL et al

It is certified that error appears in the above-identified patent and that said Letters Patent is hereby corrected as shown below:

Column 4, line 55, after "time" please delete "t" and insert --t--

Column 4, line 59, after "spacing" please delete "a" and insert --a--

Column 6, line 54, before "between" please delete "a" and insert --a--

Column 7, line 34, after "gates" please delete "41" and insert --47--

Column 7, line 35, after "gates" please delete "47" and insert --41--

Signed and Sealed this

Thirteenth Day of November, 1990

*Attest:*

HARRY F. MANBECK, JR.

*Attesting Officer*

*Commissioner of Patents and Trademarks*